US005806536A

United States Patent [19]

Tietjen

[11] Patent Number: 5,806,536

[45] Date of Patent: Sep. 15, 1998

[54] ARTIFICIAL NAIL REMOVAL ARRANGEMENT

[75] Inventor: Marlene Tietjen, New York, N.Y.

[73] Assignee: Del Laboratories, Inc., Farmingdale, N.Y.

[21] Appl. No.: 798,860

[22] Filed: Feb. 11, 1997

[51] Int. Cl.[6] ..... A45D 29/00

[52] U.S. Cl. ..... 132/73; 132/76.4

[58] Field of Search ..... 132/76.4, 73.6, 132/74.5, 75.8, 73, 75; 15/104.04, 167.1, 167.3

[56] References Cited

U.S. PATENT DOCUMENTS

| | | | |
|---|---|---|---|
| 2,629,124 | 2/1953 | Merritt | 132/73 |
| 2,771,621 | 11/1956 | Erickson | 15/167.1 |
| 4,439,884 | 4/1984 | Giorni | 15/104.04 |
| 4,440,181 | 4/1984 | Scherer | 132/75 |
| 4,459,987 | 7/1984 | Pangburn | 132/76.4 |
| 4,644,966 | 2/1987 | Ferrari | 132/73 |
| 4,819,672 | 4/1989 | Walker et al. | 132/75 |
| 5,048,547 | 9/1991 | Walker | 132/75 |
| 5,054,503 | 10/1991 | Keller | 132/73 |
| 5,065,778 | 11/1991 | Terrell | 132/73 |

*Primary Examiner*—Todd E. Manahan
*Assistant Examiner*—Eduardo C. Robert
*Attorney, Agent, or Firm*—Kirschstein et al.

[57] ABSTRACT

An abrasive pad having multiple abrasive fibers is confined within a cylindrical vessel having nail polish solvent. The pad has an oversized finger hole in which one or more fingers having artificial nails can be accommodated. The artificial nails are removed by rubbing the artificial nail against the abrasive pad.

1 Claim, 1 Drawing Sheet

ARTIFICIAL NAIL REMOVAL ARRANGEMENT

BACKGROUND OF THE INVENTION

1. Field of The Invention

The present invention relates to artificial nails in general, and more particularly to an arrangement for removing artificial nails from natural human fingernails.

2. Description of the Related Art

It is already known to remove nail polish from fingernails by various arrangements. Thus, U.S. Pat. No. 4,282,891 discloses a fingernail treating device that includes a flat-bottomed cylindrical container in which there is inserted a cylindrical, soft sponge having a diameter somewhat exceeding the internal diameter of the container to be press-fitted therein and thus prevented from displacement relative to the container. The soft, resilient sponge is provided with slits or with a blind hole, so that the user of this device can snugly insert a finger bearing polish on the nail, either into the slits, pushing the sponge out of the way during insertion, or into the blind hole.

As the fingernail comes into contact with the sponge, the treating liquid, such as polish remover solvent, which permeates the sponge, will dissolve the nail polish, and the friction between the sponge and the fingernail during the insertion, withdrawal, or other movement of the finger will remove at least a predominant part of the nail polish and retain the dissolved nail polish in the sponge. The finger may be turned or oscillated in the finger hole to speed up and otherwise improve the action of the solvent on the nail polish.

Other fingernail treatment arrangements are described in U.S. Pat. No. 4,466,452 and No. 4,644,966, where again, a soft, resilient, cylindrical sponge saturated with a polish remover liquid is held in a container. The user's polish-bearing finger is snugly received in a finger hole formed in the sponge, whereupon repeated subsequent rubbing tends to dissolve the polish from the fingernail.

Although generally satisfactory for their intended nail polish removing purpose, the known polish removal treatment arrangements are not satisfactory when an artificial nail, rather than nail polish, is to be removed from one's natural nail. An artificial nail, typically constituted of a synthetic plastic material, and/or of one or more wraps of a fabric, for example, Chinese silk, and/or of one or more wraps of paper, is affixed to a natural nail by various techniques, virtually all of which require at least one layer, and typically multiple layers, of a glue, especially a permanent cyanoacrylate glue. Each application of permanent glue may be accompanied by the application of powder and gel compounds.

The result, especially when one considers that an artificial nail is painstakingly administered to, strengthened and re-strengthened periodically, for example, at weekly appointments at a nail salon, is an artificial nail whose attachment to the natural nail is so secure that it is not uncommon for one desiring to remove artificial nails to have to soak her artificial nails in a solvent for time periods on the order of one hour. Even then, the wraps, the glue and the other remnant constituents of the artificial nail and its attachment typically have to be physically peeled or scraped off the human nail, thereby making the entire procedure laborious, time-consuming and uncomfortable.

SUMMARY OF THE INVENTION

Objects of The Invention

Accordingly, it is a general object of the present invention to avoid the disadvantages of the prior art.

More particularly, it is an object of the invention to provide an arrangement for removing artificial nails with a treating liquid, which does not possess the disadvantages of the conventional arrangements of this type.

Still another object of the present invention is so to construct the arrangement of the above type as to obtain an improved treating action.

It is yet another object of the present invention to develop an arrangement of the above type in which the time needed for removing the artificial nails is reduced, the penetration of the solvent to the attachment of the artificial nail is enhanced, and the comfort to the user is increased.

A concomitant object of the invention is so to design the arrangement as to be simple in construction, inexpensive to manufacture, easy to use, and reliable in operation nevertheless.

Features of the Invention

In pursuance of these objects and others which will become apparent hereafter, one feature of the present invention resides in an arrangement for removing an artificial nail from a natural human fingernail. The arrangement includes a vessel having a cylindrical wall and a bottom wall bounding a chamber. A treatment liquid, e.g., a solvent, is accommodated in the chamber. The solvent normally contains acetone and reacts to dissolve nail polish, artificial nails, and polycyanoacrylate and acrylic dipping powders.

In accordance with this invention, an abrasive pad extends entirely along the cylindrical wall within the chamber and is constituted of abrasive fibers having interstices in which the liquid is received. The abrasive pad has a central finger hole for receiving an artificial nail to be removed, with clearance, to permit movement of the artificial nail against the abrasive fibers.

The abrasive pad, in contrast to the soft, resilient sponges known in the prior art, aggressively attacks the artificial nail and its adhesive attachment to the fingernail. The pad secures itself in a fixed position within the chamber.

Preferably, the finger hole is oversized so that it can accommodate all the fingers of one's hand. Hence, much less time is required to remove each artificial nail than heretofore which, of course, contributes to a more enjoyable, comfortable and shorter session at the nail salon.

The novel features which are considered as characteristic of the invention are set forth in particular in the appended claims. The improved artificial nail treatment arrangement itself, however, both as to its construction and its method of operation, together with additional objects and advantages thereof, will be best understood from the following detailed description of certain specific embodiments with reference to the accompanying drawing.

DETAILED DESCRIPTION OF THE PREFERRED EMBODIMENT

Figure 1:
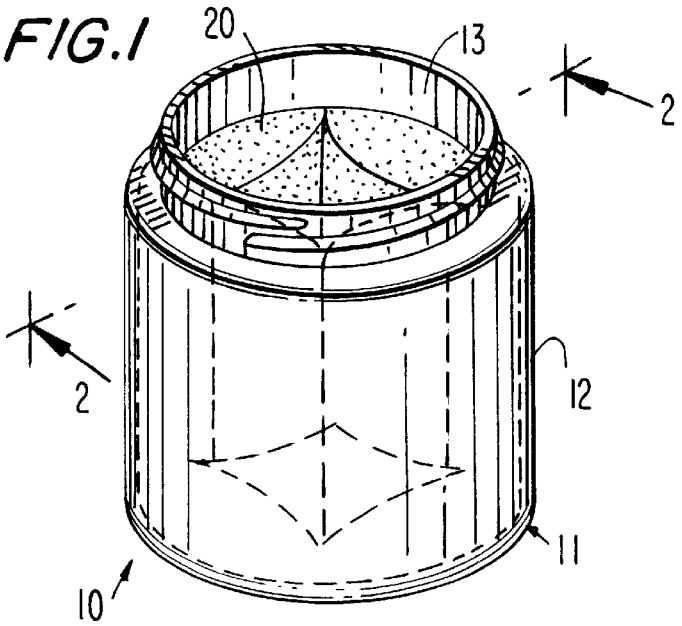
FIG. 1 is a perspective view of a vessel according to the present invention in an open condition ready for use.

Referring now to the drawing in detail, and first to FIG. 1 thereof, it may be seen that the reference numeral 10 has been used therein to identify an artificial nail treatment arrangement of the present invention in its entirety. The arrangement 10 includes a vessel 11 and a non-illustrated lid or cover for the vessel 11. As shown in detail in FIG. 2, the vessel 11 has an externally threaded neck portion 13. The lid has an internally threaded rim portion which meshes with the neck portion 13 in a closing position of the lid.

Figure 2:
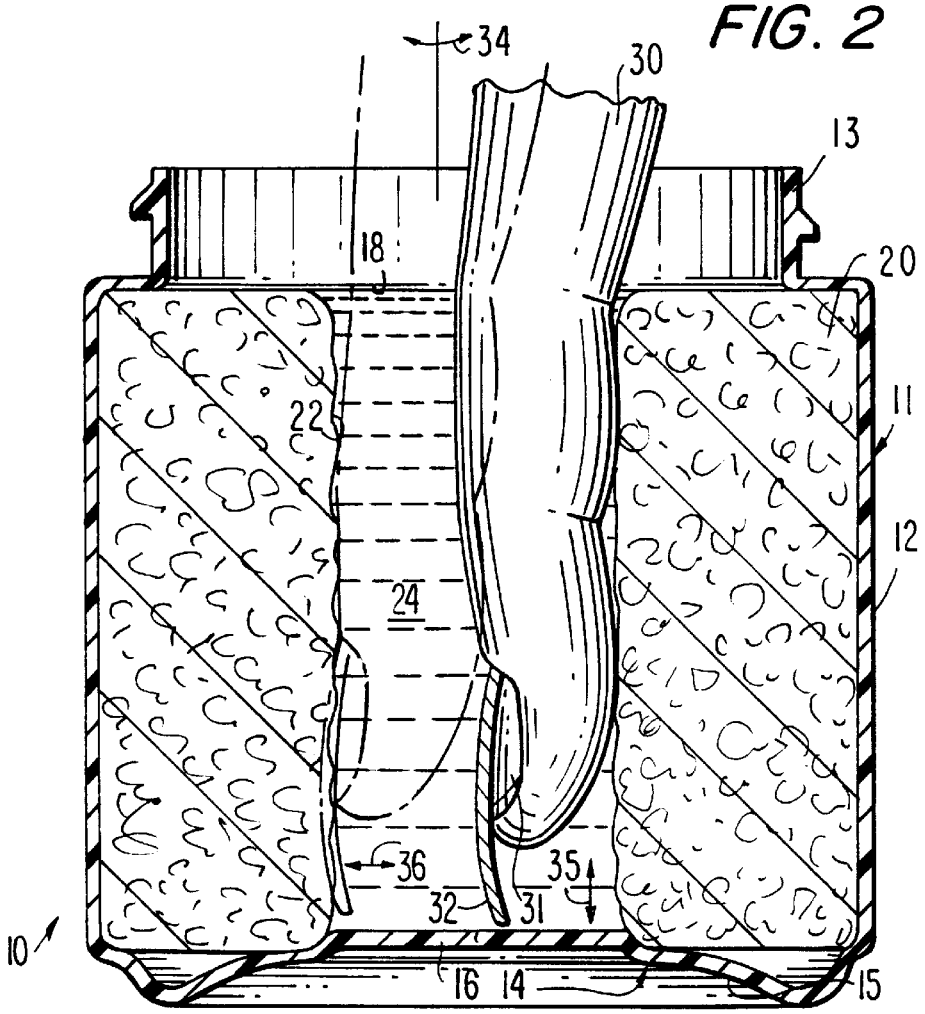
FIG. 2 is a sectional view taken on line 2—2 of FIG. 1 during use.

The vessel 11 further includes a circumferential cylindrical wall 12 which adjoins the neck portion 13 and has a diameter exceeding that of the latter, and a bottom wall 14 which extends across the space bounded by the circumferential wall 12 at an end portion of the latter which is remote from the neck portion 13. As shown in FIG. 2, for instance, the bottom wall 14 has an outer, annular portion 15 curved in the upward direction, that is, it is concave as viewed from an internal chamber 18 of the vessel 11 which is bounded by the circumferential and bottom walls 12, 14, as well as a central, circular, raised portion 16 that extends into the chamber 18.

An abrasive pad 20 is received in the chamber 18. The pad 20 is an intertwined network of abrasive, rough fibers. The fibers are long, stringy, wire-like and coarse to the touch, and can be constituted of natural or synthetic fibers, especially polypropylene. In a preferred embodiment, the pad 20 is an elongated strip approximately 8" in length, 2" in height, and ¾ in thickness. The pad is formed into a cylinder by bringing the opposite ends of the strip together. The thus-formed cylindrical pad in then inserted through the neck portion 13 and into the chamber 18 where the pad is placed against the inner circumferential surface of the wall 12. The length of the pad is slightly longer than the inner circumference of the wall 12. The abrasive pad is retained against extraction through the neck portion and against rotation about an upright axis by the pad itself which anchors itself due to its greater length that tends to push the pad radially against the wall 12.

The abrasive pad has a central finger hole 22 which extends all the way through the pad to the raised portion 16 of the bottom wall 14 and opens onto the same. The raised portion 16 serves to assist in centering and anchoring the pad in place. The finger hole 22, as shown in FIG. 2, is oversized as compared to the transverse dimensions of a single finger. Indeed, in the preferred embodiment, all five of a user's fingers can simultaneously be accommodated in the finger hole 22, with room to spare.

Hence, one or more fingers of the user of the arrangement 10 can be introduced into the finger hole 22 after the removal of the lid. A predetermined quantity of a treating liquid is introduced into the internal chamber 18 of the vessel 11 prior to the use of the arrangement 10, to form a liquid body 24 therein. The liquid body 24 will be partially received in the interstices of the pad 20, and the remaining liquid will be collected in the finger hole 22. The liquid itself is a solvent, preferably containing acetone, ethyl acetate, isopropyl alcohol, water, estasol DBE, panthenol and Vitamin E acetate as the primary ingredients. The solvent reacts to dissolve nail polish, artificial nails and dipping powders. The pad is resistant to the solvent.

Having so described the construction of the artificial nail treating arrangement 10 according to the present invention, its operation will now be explained with reference to the embodiment of FIG. 2, where the reference numeral 30 has been used to identify a finger of the user of the arrangement 10, while the reference numeral 31 has been used to designate a natural fingernail, and the reference numeral 32 has been used to designate an artificial nail to be removed. The artificial nail, as previously defined, includes a plastic overlay and/or one or more fabric or paper wraps, nail tips, and/or powder, gels, acrylics and glue, especially the cyanoacrylate glues, or any combination of the above constituents.

The user of the arrangement inserts one or more fingers 30 into the finger hole 22, and orbits or rotates the fingers, as indicated by an arrow 34 about the vertical axis, or reciprocates the fingers up-and-down in the finger hole, as indicated by an arrow 35, or moves the fingers back-and-forth through the oversized finger hole 22, as indicated by an arrow 36. During this movement, the artificial fingernail 32 will rub forcefully against the liquid-soaked surface of the abrasive pad 20, so that the attachment of the artificial nail will be rapidly attacked and softened by the treating liquid. The loosened attachment can easily be scraped and buffed away.

It will be understood that each of the elements described above, or two or more together, may also find a useful application in other types of constructions differing from the type described above.

While the present invention has been described and illustrated herein as embodied in an arrangement for removing artificial nails, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims:

1. An arrangement for removing an artificial nail from a natural human fingernail, comprising:

a) a vessel having a cylindrical wall which has a circumference and a height, and a bottom wall bounding a chamber;

b) a treatment liquid including a solvent for the artificial nail in the chamber; and c) an abrasive pad extending along the cylindrical wall within the chamber and constituted of an intertwined network of elongated, abrasive fibers having interstices in which the liquid is received, said abrasive pad being constituted of an elongated strip of the abrasive fibers, said strip having opposite ends which engage each other when the abrasive pad is in the chamber, said strip having a length greater than said circumference and extending entirely along said circumference and entirely over said height of the cylindrical wall, said abrasive pad having a central finger hole for receiving the artificial nail to be removed, with clearance, to permit forceful rubbing movement of the artificial nail against the abrasive fibers.

* * * * *